US006643995B1

(12) United States Patent
Koyama et al.

(10) Patent No.: US 6,643,995 B1
(45) **Date of Patent: *Nov. 11, 2003**

(54) PROCESS AND APPARATUS FOR MANUFACTURING PACKAGES

(75) Inventors: Yasuhiro Koyama, Kagawa (JP); Takeshi Bando, Kagawa (JP); Yukiko Iida, Kagawa (JP); Ikuya Saitou, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/575,016

(22) Filed: May 19, 2000

(30) Foreign Application Priority Data

May 24, 1999 (JP) ..... 11-143041

(51) Int. Cl.[7] ..... B65B 47/00

(52) U.S. Cl. ..... 53/453; 53/329.3; 493/89; 229/125.35

(58) Field of Search ..... 53/559, 453, 431, 53/450, 550, 456, 460, 467, 471, 131.1, 138.1, 329.3, 370.2, 373.4, 375.9, 487, 579, 282; 206/494; 29/125, 35, 186; 383/66; 493/102, 84, 89, 156, 162, 396, 63

(56) References Cited

U.S. PATENT DOCUMENTS

| | | | | | |
|---|---|---|---|---|---|
| 820,976 | A | * | 5/1906 | Katzinger | 72/379.4 |
| 2,972,215 | A | * | 2/1961 | Danielzig et al. | 53/579 |
| 3,056,245 | A | * | 10/1962 | Baum et al. | 53/436 |
| 3,367,555 | A | * | 2/1968 | Montgomery | 229/125.35 |
| 3,917,155 | A | * | 11/1975 | Bemiss | 229/169 |
| 3,972,155 | A | * | 8/1976 | Mahaffy et al. | 53/453 |
| 4,338,766 | A | | 7/1982 | Hamilton | 53/456 |
| 4,721,040 | A | * | 1/1988 | Mau | 100/211 |
| 4,998,669 | A | * | 3/1991 | Karolyi | 229/170 |
| 5,433,374 | A | * | 7/1995 | Forbes, Jr. | 229/125.35 |
| 6,119,439 | A | * | 9/2000 | Stevie | 53/455 |
| 6,273,610 | B1 | * | 8/2001 | Koyama et al. | 383/207 |

* cited by examiner

*Primary Examiner*—Stephen F. Gerrity
*Assistant Examiner*—John Paradiso
(74) *Attorney, Agent, or Firm*—Darby & Darby

(57) ABSTRACT

A box body (11) having a bottom face portion (12), side face portions (13, 14) and corner sealing portions (15) is formed of a packaging material of a soft sheet, and flange portions (16, 17) and flange jointing portions (18) are formed by folding the upper portions of the side face portions (13, 14). After this box body (11) is charged with a content, a cover member (30) is jointed to the flange portions.

8 Claims, 9 Drawing Sheets

PROCESS AND APPARATUS FOR MANUFACTURING PACKAGES

BACKGROUND OF THE INVENTION

1. Field of the Invention

The present invention relates to process and apparatus for manufacturing a package of a soft sheet for packaging a content such as dry tissues, wet tissues, wipes, sanitary napkins, granular articles, foods or the like or even liquids.

2. Related Art

The package of the soft sheet is generally exemplified by a lengthwise pillow type. FIG. 11 is a perspective view showing the lengthwise pillow type package of the prior art for packaging wet tissues.

A process for manufacturing the package shown in FIG. 11 includes: the step of jointing the edge portions of packaging materials (1) of a soft sheet having laminated aluminum foils and resin films in a joining state to form a longitudinal sealing portion in a cylindrical shape; and the step of sealing the two longitudinal end portions of the cylindrical packaging material (1) to form side sealing portions (2) and (3). Generally, with one side sealing portion (2) being formed, the packaging material (1) is charged with a content from the other opening, and this opening is closed to form the side sealing portion (3).

At a step before forming the longitudinal sealing portion, on the other hand, an opening (4) is formed in a portion of the packaging material (1). At either step, on the other hand, a cover sheet (6) for closing the opening (4) is adhered through such an adhesive layer (or sticking layer) as can be repeatedly peeled and adhered.

The package, as shown in FIG. 11, can be continuously manufactured by the aforementioned lengthwise pillow type manufacture process and apparatus. In the completed package, however, the so-called "gusset folds" (7, 7) are formed on the two sides of the side sealing portions (2) and (3) so that the height size of the package becomes so gradually thinner at the gusset folds (7, 7) as to merge into the side sealing portions (2) and (3). When a cubic content such as stacked wet tissues is packaged, therefore, it cannot be accommodated in a portion of a size L containing the gusset folds (7, 7). This makes the entire volume of the package larger than the content volume. In the longitudinal direction of the package, moreover, the side sealing portions (2) and (3) protrude to enlarge the outer size of the package more.

As a result, there arises a problem that when a small-sized package for packaging a stack of small-folded wet tissues (5) is to be formed, the size of the entire package cannot be sufficiently reduced.

In the prior art, on the other hand, a variety of packaging materials are used to manufacture a box-shaped package. If the package for packaging the content is formed into the box shape, no wasteful space is left in the package, and the large projections such as the side sealing portions (2) and (3) can be eliminated.

According to a general process for manufacturing the box-shaped package of that kind, a hard PET resin sheet is vacuum- or pressure-formed. However, this vacuum- or pressure-forming method requires a forming step using a mold so that it raises the cost. In order to change the size of the package, on the other hand, the mold has to be remade so that a large change cannot be followed. Since the emptied package is hard, moreover, it increases the volume of waste when disposed.

In the food packaging field, on the other hand, there exists a package which is formed from paper into a box shape. However, this paper package has its strength lost when charged with a wet content.

SUMMARY OF THE INVENTION

According to an aspect of the invention, there is provided a process for manufacturing a package including a box body formed of a packaging material of a soft sheet and a cover member for closing the opening of the box body, comprising:

(a) the step of forming a box body including a rectangular bottom face portion (12) and four side face portions (13, 14) folded from the four sides of the bottom face portion, of a packaging material of a soft sheet having a monolayer of a resin film or a multi-layer structure having a resin film, to form triangular folded projecting portions (21) projecting outward of the box body at corner portions (20) between first and second side face portions (13, 14) adjoining to each other;

(b) the step of jointing the inner faces of the folded projecting portions (21) along the corner portions (20) and while leaving a predetermined size (W1) from the upper ends of the side face portions (13, 14), to form corner sealing portions (15);

(c) the step of jointing, before or after the step (b) or simultaneously with the step (b), the inner faces of the folded projecting portions (21) in the upper portions of the folded projecting portions (21) and while leaving non-jointed portions of triangular regions (25) using the corner portions (20) as their one side, to form jointed sealing portions (24);

(d) the step of folding the upper portions of the side face portions (13, 14) outward with a predetermined width size (W1) to form first and second flange portions (16, 17) continuing to the upper ends of the first and second side face portions (13, 14), respectively, and simultaneously developing the triangular regions (25) to form flange jointing portions (18) continuing planarly to the individual first and second flange portions (16, 17); and (e) the step of jointing a cover member (30) to the upper faces of the flange portions (16, 17) and the flange jointing portions (18) developed planarly at the step (d).

The package manufacturing process is preferred to further comprise: the step of cutting, simultaneously with or after the step (b) or the step (c), the folded projecting portions (21) to leave narrow portions (22) including the corner sealing portions (15) and small triangular portions (23) along the jointed sealing portions (24).

The cutting step leaving the narrow portions and the small triangular portions is effective when the box body of the package to be manufactured is deep. In the box body having a large depth and high side face portions, the folded projecting portions (21) have a large projection size. By cutting these folded projecting portions (21) into the aforementioned shape, therefore, the size of the sideway projecting portions from the corners of the box body can be reduced. In the shallow box body having low side face portions, however, the projection size of the folded projecting portions (21) from the corners is intrinsically small, and it is unnecessary to dare to cut the folded projecting portions.

On the other hand, the package manufacturing process, may further comprise, in place of the steps (d) and (e):

(f) the step of folding the four sides of a rectangular cover member (30) to form a rectangular flat face portion (33)

having substantially the same size as that of the bottom face portion (12), folded portions (31) folded from the four sides of the flat face portion (33), and triangular folded portions (34) protruding outward of the cover member at the intersections of the folded portions (31);

(g) the step of fitting the flat face portion (33) of the cover member (30) in the opening of the box body formed at the step (c), such that the folded portions (34) are inserted in the triangular regions (25) of the box body, to joint the inner faces of the side face portions (13, 14) and the outer faces of the folded portions (31); and (h) the step of folding the upper portions of the side face portions (13, 14) outward with a predetermined width size (W1) to form flange portions (16, 17) and flange jointing portions (18) developed from the triangular regions (25), and developing the cover member (30).

At the step (a), on the other hand, a packaging material having a predetermined width and continuing in a band shape can be fed to form a plurality of box bodies continuing through a boundary region (iii) in the longitudinal direction of the packaging material.

However, the box bodies of the package can also be separately manufactured one by one.

In the continuous manufacture case, on the other hand, at the step (d), the upper portions of the second side face portions (14, 14) raised from the two widthwise sides of the band-shaped packaging material can also be folded to form the second flange portions (17, 17), and the spacing between the adjoining box bodies can also be enlarged to develop the boundary portion (iii) in a planar shape thereby to form the first flange portions (16, 16) and to develop the flange jointing portions (18) in a planar shape.

After the cover member was jointed to the box body, the boundary portion (iii) between the box bodies may be cut to separate them into individual box bodies.

Alternatively, after the cover member was jointed to the box body, the boundary portion between the box bodies may be cut at every other ones to separate an assembly having a plurality of box bodies continuing through the boundary portion. Moreover, the boundary portion (iii) connecting the plurality of box bodies may be perforated.

According to another aspect of the invention, there is provided an apparatus for manufacturing a package including a box body formed of a packaging material of a soft sheet and a cover member for closing the opening of the box body, comprising:

a packaging material feeding portion for letting off a band-shaped packaging material (35) of a soft sheet having a monolayer of a resin film or a multi-layer structure having a resin film, in a longitudinal direction;

a plurality of partitions (44) moving at a predetermined interval in the direction to feed the band-shaped packaging material, and a bottom positioning portion (45) interposed between the partitions;

a pusher (47) for pushing the band-shaped packaging material (35) onto the confronting inner faces of the partitions (44) and the bottom positioning portion (45), to form the packaging material (35) into a shape of letter "C" and to form a bottom face portion (12) in close contact with the bottom positioning portion (45) and first side face portions (13, 13) in close contact with the inner faces of the partitions (44);

folding means (48) for raising the two widthwise side portions of the band-shaped packaging material (35) to form second side face portions (14, 14) intersecting the first side face portions (13, 13) at a right angle thereby to form the packaging material (35) into a box body, and simultaneously to form triangular folded projecting portions (21) projecting from corner portions (20) between the first side face portions (13) and the second side face portions (14);

sealing means (51, 52) for jointing the inner faces of the folded projecting portions (21) along the corner portions (20) and while leaving only a predetermined size (W1) from the upper ends of the side face portions (13, 14), to form corner sealing portions (15), and for jointing the inner faces of the folded projecting portions (21) continuing to the corner sealing portions and while leaving non-jointed portions of triangular regions (25) using the corner portions (20) as their one side, to form jointed sealing portions (24);

developing means for folding the upper portions of the first and second side face portions (13, 14) outward with a predetermined width size (W1) to form first and second flange portions (16, 17) continuing to the upper ends of the first and second side face portions (13, 14), respectively, and for simultaneously developing the triangular regions (25) to form flange jointing portions (18) continuing planarly to the individual first and second flange portions (16, 17);

sealing means (61, 62) for jointing a cover member (30) to the upper faces of the flange portions (16, 17) and the flange jointing portions (18) developed in a planar shape; and cutting means (63) for cutting the box bodies having the cover members jointed thereto, individually into one or a plurality.

This package manufacturing apparatus can further comprise: cutting means for cutting the folded projecting portions (21) while leaving narrow portions (22) including the corner sealing portions (15) and small triangular portions (23) along the jointed sealing portions (24).

DESCRIPTION OF THE PREFERRED EMBODIMENTS

Figure 2:
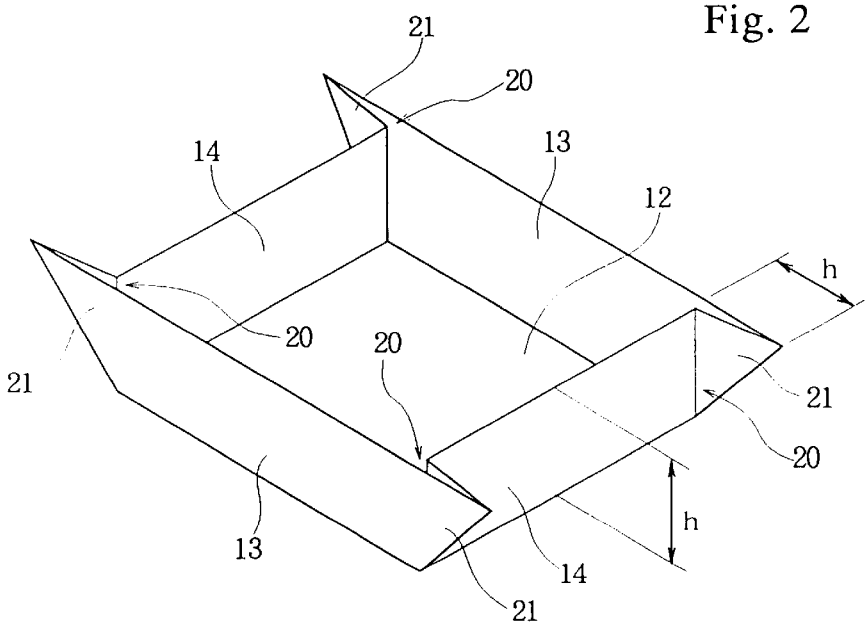
FIG. 2 is a perspective view showing the state in which a packaging material is folded to form side face portions and folded projections in a package manufacturing process according to one embodiment of the invention.
Figure 3:
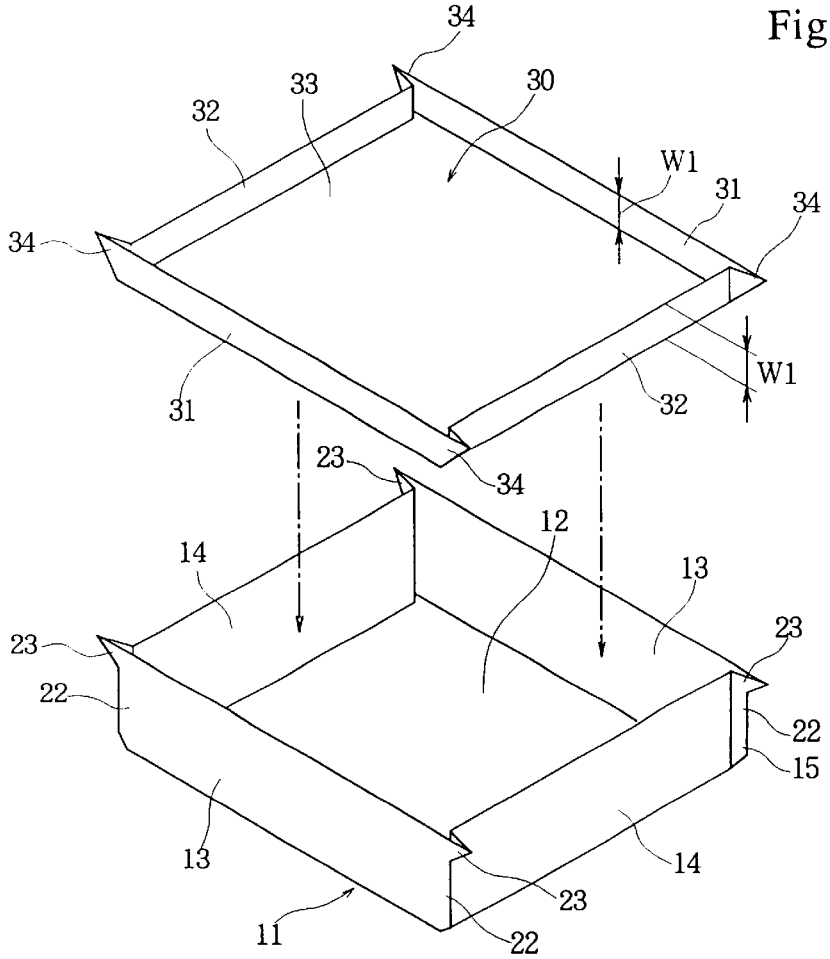
FIG. 3 is a perspective view showing the state in which a cover member having four folded sides is laid over a box body.
Figure 4:
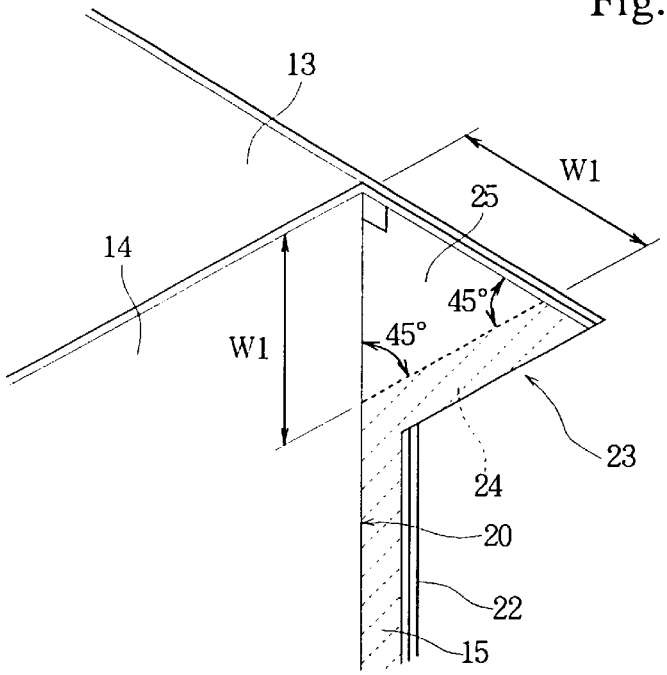
FIG. 4 is a perspective view showing a structure of a flange jointing portion before developed.
Figure 5:
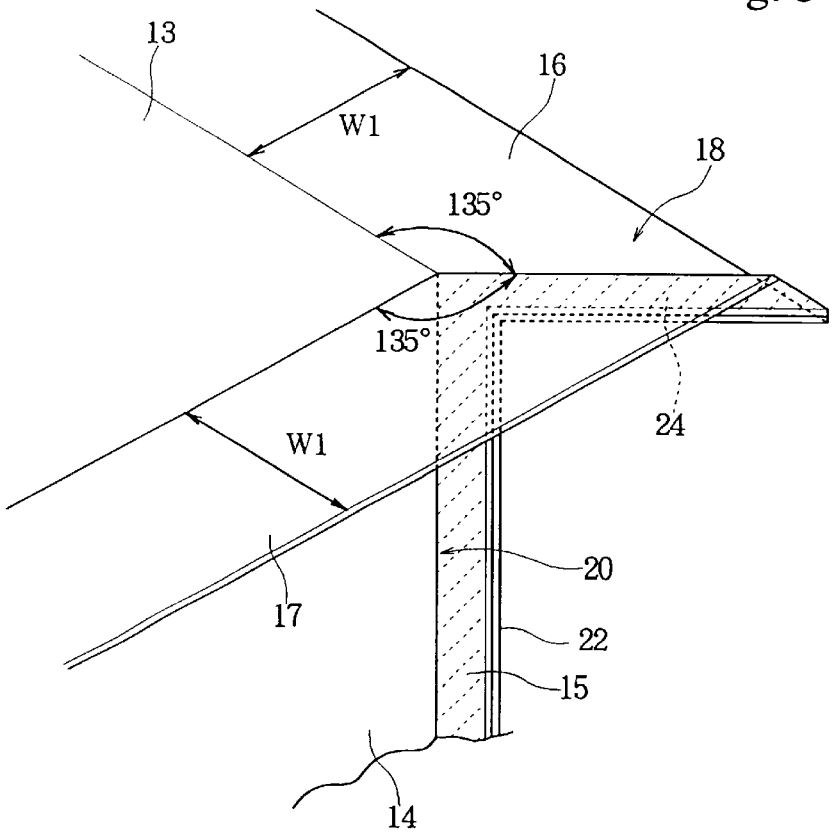
FIG. 5 is a perspective view showing the flange jointing portion after developed.

FIGS. 1A, 1B, 2 and 3 are perspective views showing a process for manufacturing a package of a soft sheet according to one embodiment of the invention, and FIGS. 4 and 5 are perspective views showing a structure of a flange jointing portion.

Figure 1A:
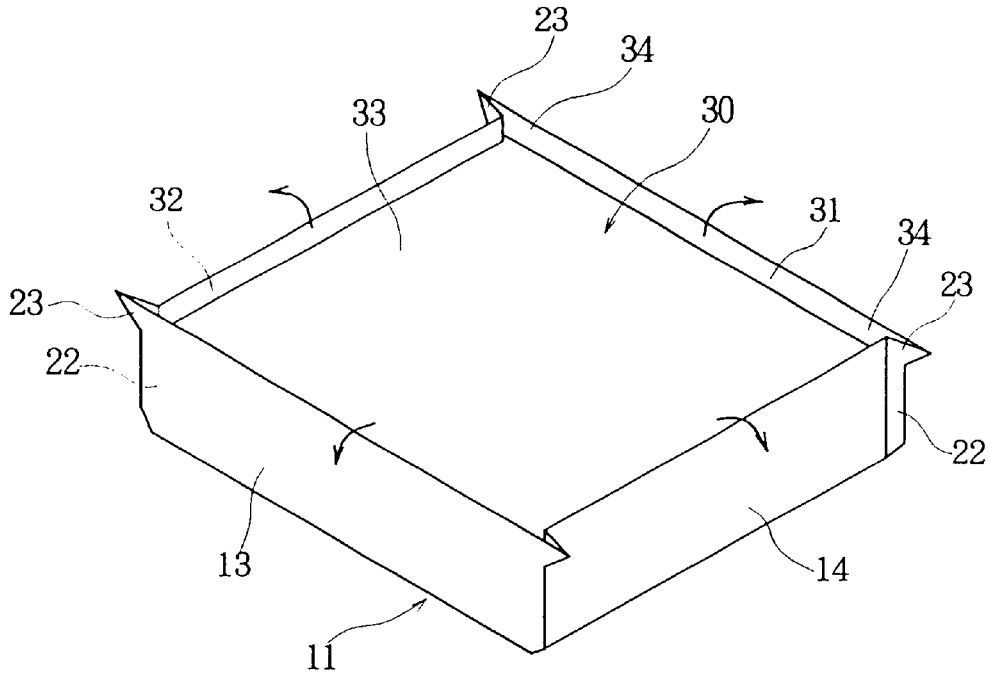
FIG. 1A is a perspective view showing the state in which flange portions of a package are not developed in a package manufacturing process according to one embodiment of the invention.
Figure 1B:
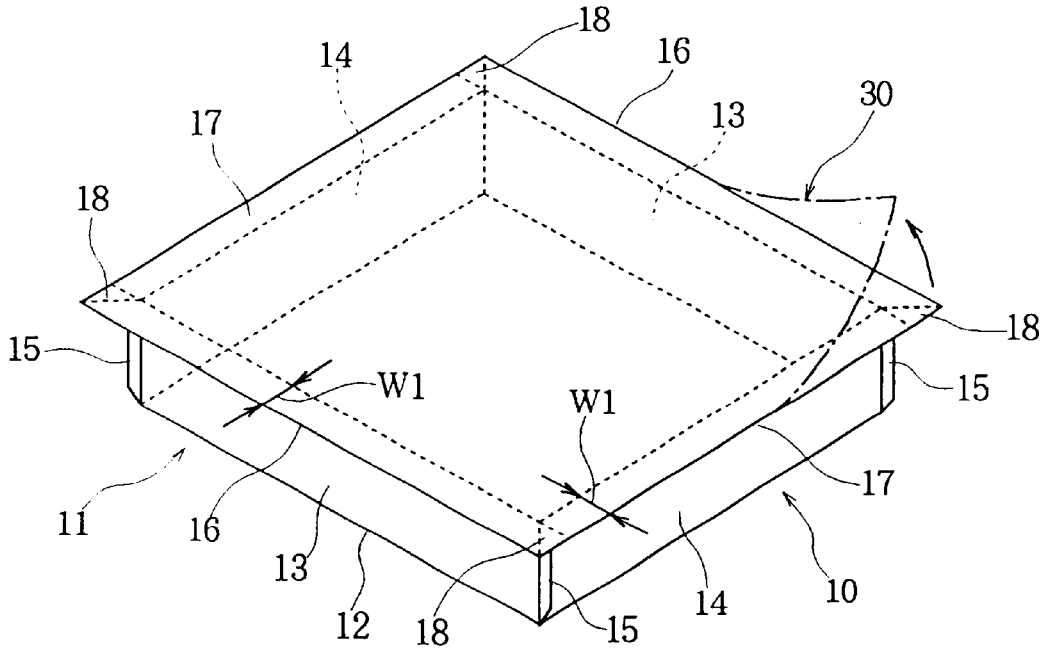
FIG. 1B is a perspective view showing the state in which the flange portions of the package of FIG. 1A are developed.

FIG. 1B shows a completed state of a package (10), as formed of a soft sheet according to one embodiment of the invention.

This package (10) is constructed to include a cubic or prism-shaped box body (11), and a cover member (30) for covering the opening of the box body (11).

The box body (11) is formed of a packaging material of a soft sheet. This packaging material has a monolayer structure of a resin film or a multi-layer structure including a resin film. The monolayer packaging material is exemplified by a resin film such as high density polyethylene, low density polyethylene, polypropylene, polyethylene terephthalate or nylon, and the multi-layer packaging material is exemplified by a laminate material formed of any combination of the aforementioned monolayer resin films. In use for wrapping food, on the other hand, the packaging material may be a multi-layer film having the so-called "gas barrier properties" and containing polyvinylidene chloride or ethylene-vinyl acetate copolymer. Alternatively, the packaging material may be a laminate of a net-shaped split clock (for example, a sheet formed by interposing a net-shaped material between two non-woven fabrics and subjecting it to a water jetting treatment) and any of the aforementioned resin films. For a wet content, on the other hand, there may be preferably used a laminate of a resin film of polyethylene and/or polypropylene and a metal foil such as aluminum foil, or a resin film of a polyethylene or polyester deposited with silica or a metal layer of aluminum.

On the other hand, the cover member (30) may also be formed of the same monolayer film or multi-layer soft sheet as that of the box body (11).

Here, the "soft sheet" forming the box body (11) and the cover member (30) means such a flexible packaging material as can be folded or crushed and can be disposed of as a waste when emptied of its content.

The box body (11) and the cover member (30) may be formed of sheet materials of the same rigidity, but the box body (11) may be formed of a packaging material of a soft sheet more rigid than that of the soft sheet making the cover member (30). In this case, the box body (11) has an excellent shape retention when filled with the content. If the cover member (30) having an easy peeling type sealant layer on its portion to face the box body (11) is employed and heat-sealed to the box body (11), on the other hand, it can be easily peeled off the box body (11) with fingers, as indicated by broken lines in FIG. 1B.

The box body (11) is formed to have a rectangular bottom face portion (12), side face portions (13, 13) folded at a right angle from the two longer sides of the bottom face portion (12), side face portions (14, 14) folded at a right angle from the two shorter sides of the bottom face portion (12), and corner sealing portions (15) for jointing the adjoining ones of the side face portions (13) and the side face portions (14) to each other at the corners, while leaving an upward opening.

On the other hand, the upper portions of the side face portions (13, 13) are folded generally at a right angle outward of the box body (11) to form flange portions (16, 16), and the upper portions of the side face portions (14, 14) are likewise folded generally at a right angle outward of the box body (11) to form flange portions (17, 17). Over the corners between the side face portions (13) and the side face portions (14), on the other hand, there are formed flange jointing portions (18) at which the flange portions (16, 16) and the flange portions (17, 17) are jointed without any clearance.

As a result, all the flange portions (16, 16), the flange portions (17, 17) and the four flange jointing portions (18) are so formed throughout the periphery of the four sides of the upward opening of the box body (11) as to form a plane parallel to the bottom face portion (12). Moreover, the cover member 30 is jointed through an easy peeling type sealant layer, for example, to the upper faces of the flange portions (16, 16), the flange portions (17, 17) and the four flange jointing portions (18).

The width size of the flange portions (16, 16) folded over the side face portions (13, 13) may be different from that of the flange portions (17, 17) folded over the side face portions (14, 14). If the width sizes are equalized or substantially equalized to a value (W1), however, the individual flange portions and the flange jointing portions (18) can be easily formed, as will be described hereinafter.

Here will be described one example of a process for manufacturing the package (10).

First of all, as shown in FIG. 2, one soft sheet is formed into the rectangular bottom face portion (12), and the side face portions (13, 13) and the side face portions (14, 14) rising perpendicularly from the four sides of the bottom face portion (12). At this time, a triangular folded projecting portion (21) is formed at each of corner portions (20) between the side face portions (13) and the side face portions (14). A projection size (h) of the folded projecting portion (21) from the corner portion (20) is equal to the height size (h) of each of the side face portions (13) and the side face portions (14). Thus, the folded projecting portion (21) has a shape of the right-angled isosceles triangle.

Next, the folded projecting portions (21) of the right-angled isosceles triangle are adhered on their inner faces to each other. As shown in FIG. 3, moreover, the folded projecting portions (21) are so partially cut off as to leave narrow portions (22) extending along the corner portions (20) and small trianglar portions (23) over the narrow portions (22).

FIG. 4 shows the narrow portion (22) and the small triangular portion (23) in an enlarged scale. A region, as hatched by broken lines in FIG. 4, indicates a portion at which the packaging materials of the soft sheet are adhered to each other. In the narrow portion (22), as shown in FIG. 4, the soft sheets are mutually adhered at a predetermined width across the corner portion (20) to form the corner sealing portion (15). At the small triangular portion (23), the soft sheets are mutually adhered at a portion of a predetermined width of the oblique side to form a jointed sealing portion (24).

The corner sealing portion (15) and the jointed sealing portion (24) continue each other. When the packaging material of the soft sheet used for forming the box body (11) is weldable on the inner face sides of the box body (11) thermally, the corner sealing portion (15) and the jointed sealing portion (24) are welded by a heat sealing method (or a thermal fusing method) using an external heat, an ultrasonic sealing method or a high-frequency sealing method using an induction heat in the resin.

In the small triangular portion (23), as shown in FIG. 4, a non-bonded triangular region (or a non-bonded region)

(25) is left in the region where the jointed sealing portion (24) is not formed. At this time, both the size of the triangular region (25) projecting from the corner portion (20) and the height size of the triangular region (25) are (W1). This size (W1) is equal to the width size (W1) of the flange portion (16) and the flange portion (17) to be formed later. In short, the triangular region (25) shown in FIG. 4 has the shape of a right-angled isosceles triangle.

In the state shown in FIG. 4, the side face portion (13) and the side face portion (14) are folded outward generally at a right angle, and the triangular regions (25) is developed to form the flange portions (16) and (17) and the flange jointing portion (18) at which the flange portion (16) and the flange portion (17) are jointed, as shown in FIG. 5. In this state of FIG. 5, the flange portion (16), the flange portion (17) and the flange jointing portion (18) are developed in a planar shape parallel to the bottom face portion (12). On the other hand, the jointed sealing portion (24) is extended outward generally at an angle of 135 degrees individually with respect to the two side face portions (13) and (14).

After the flange portion (16), the flange portion (17) and the flange jointing portion (18) were developed in the planar shape, as shown in FIG. 5, and after the box body (11) was charged with the content, the cover member (30) is jointed over the flange portion (16), the flange portion (17) and the flange jointing portion (18) of the box body (11). Alternatively, the cover member (30) may be attached by a step shown in FIG. 3 and FIG. 1A.

According to the process shown in FIG. 3, before the flange portions (16) and (17) are folded from the box body (11), the cover member (30) is folded at its four sides to form a flat face portion (33), folded portions (31, 31) and folded portions (32, 32). The flat face portion (33) of the cover member (30) is given an area equal to or slightly smaller than the opening area of the box body (11). Both the folding width sizes of the folded portions (31, 31) and the folded portions (32, 32) of the four sides of the cover member (30) are the value (W1). On the other hand, a folded portion (34) of a small triangle is formed at the corner between the folded portion (31) and the folded portion (32) of the cover member (30).

As shown in FIG. 3, the cover member (30) thus folded is fitted in the opening of the box body (11) which has been charged with the content. At this time, the folded portions (34) of the cover member (30) are inserted in the triangular regions (25) of the box body (11). This is the state of FIG. 1A. In this state of FIG. 1A, the folded portions (31, 31), and (32, 32) of the cover member (30) are temporarily or wholly adhered to the inner faces of the upper portions of the side face portions (13, 13), and (14, 14). Then, the folded portions (31, 31) of the cover member (30) and the side face portions (13, 13) of the box body (11), and the folded portions (32, 32) of the cover member (30) and the side face portions (14, 14) of the box body (11) are folded outward at a right angle to take the folded width size (W1). As a result, as shown in FIG. 1B, the cover member (30) is developed in a flat shape, and the flange portions (16), the flange portions (17) and the flange jointing portions (18) are developed and formed in the opening of the box body (11). When the cover member (30) is temporarily adhered, the cover member (30) is wholly adhered, after developed as shown in FIG. 1B, to the flange portions (16), the flange portions (17) and the flange jointing portions (18).

Here, the cover member (30) may be adhered by means of an adhesive or welded through the easy peeling type sealant layer, as described hereinbefore. In this case, the cover member (30) can be easily peeled off the box body (11).

Figure 8:
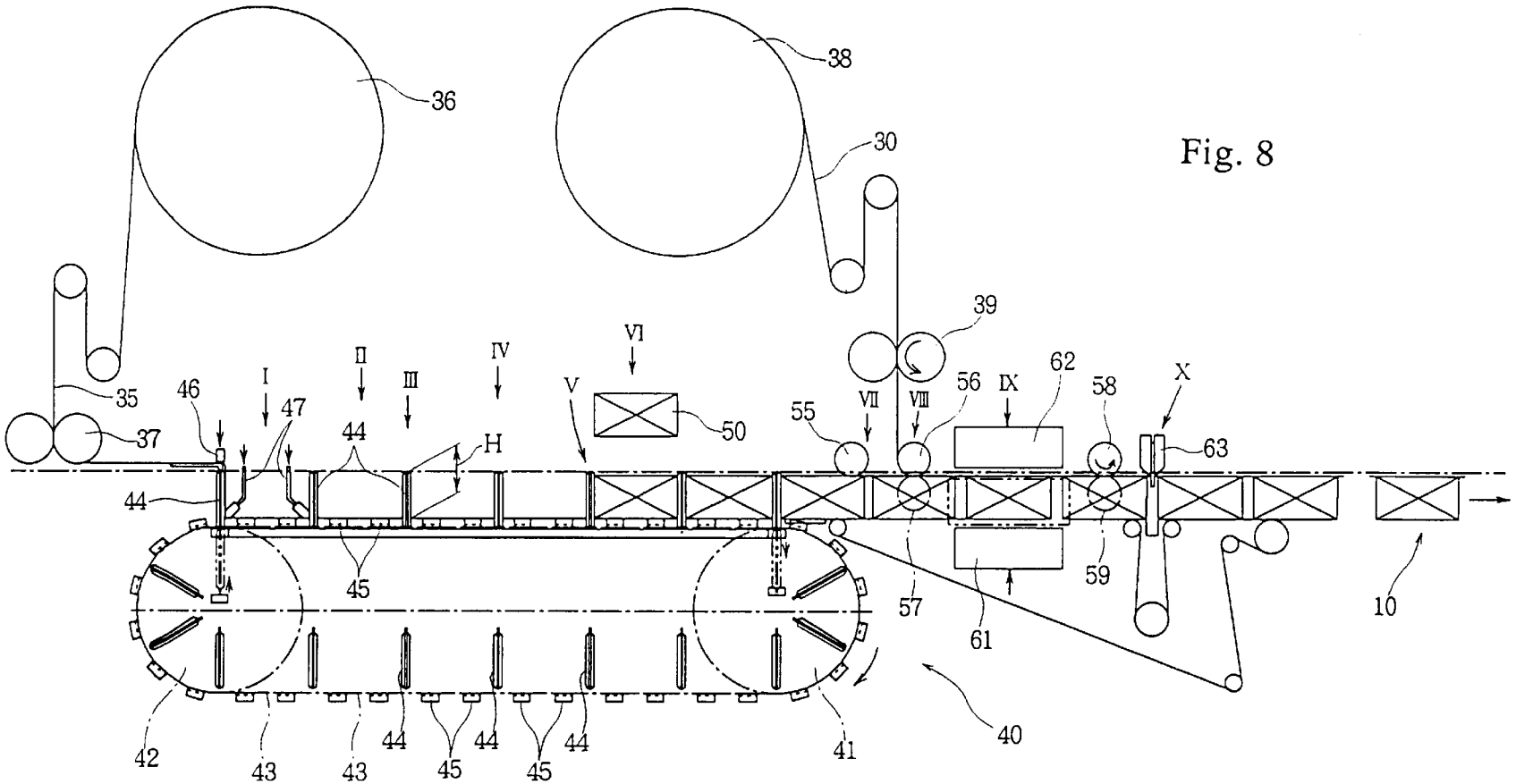
FIG. 8 is a side elevation showing the entire structure of a package manufacturing apparatus according to one embodiment of the invention.
Figure 9:
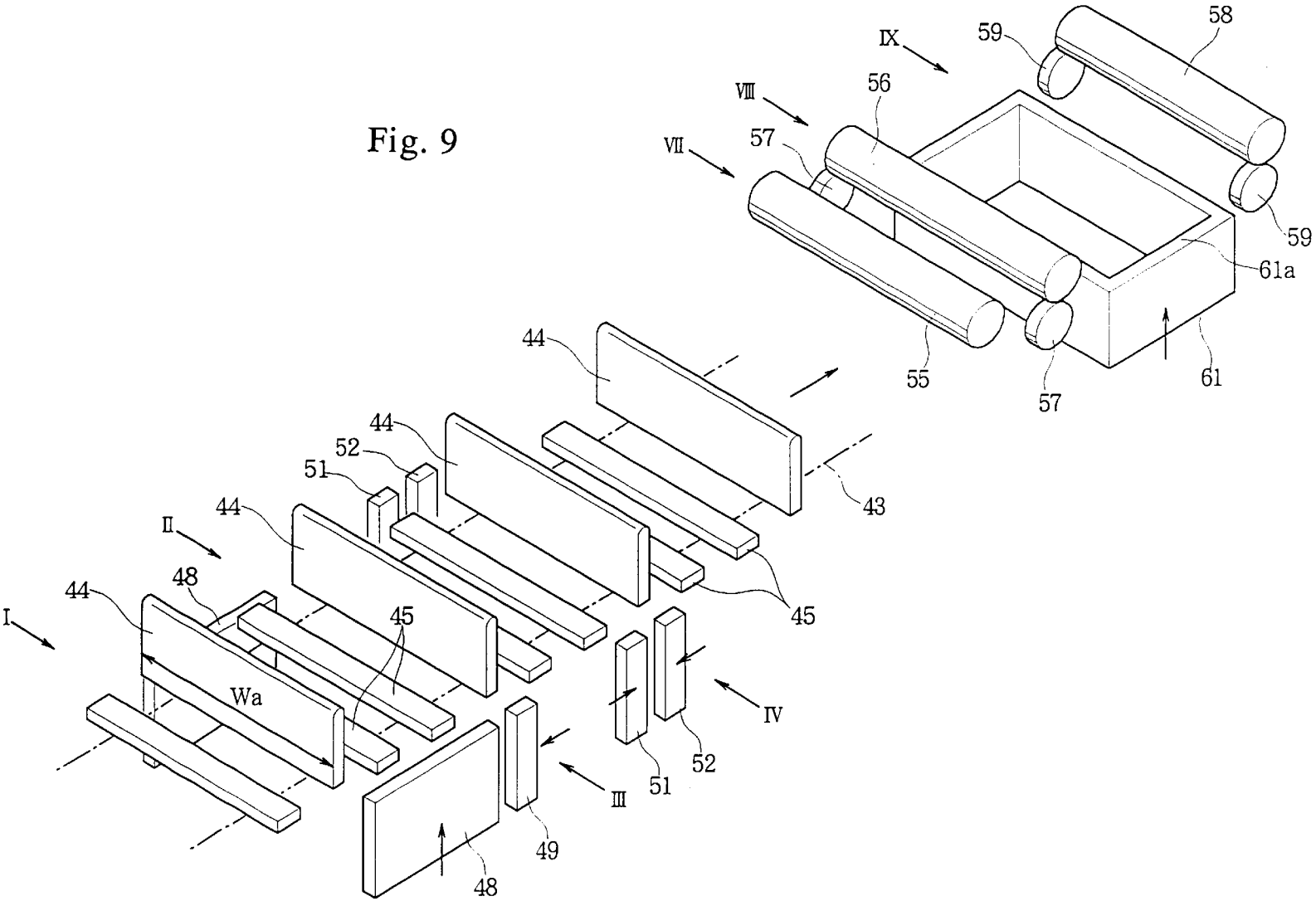
FIG. 9 is a perspective view showing an essential portion of a package manufacturing apparatus according to one embodiment of the invention.
Figure 10:
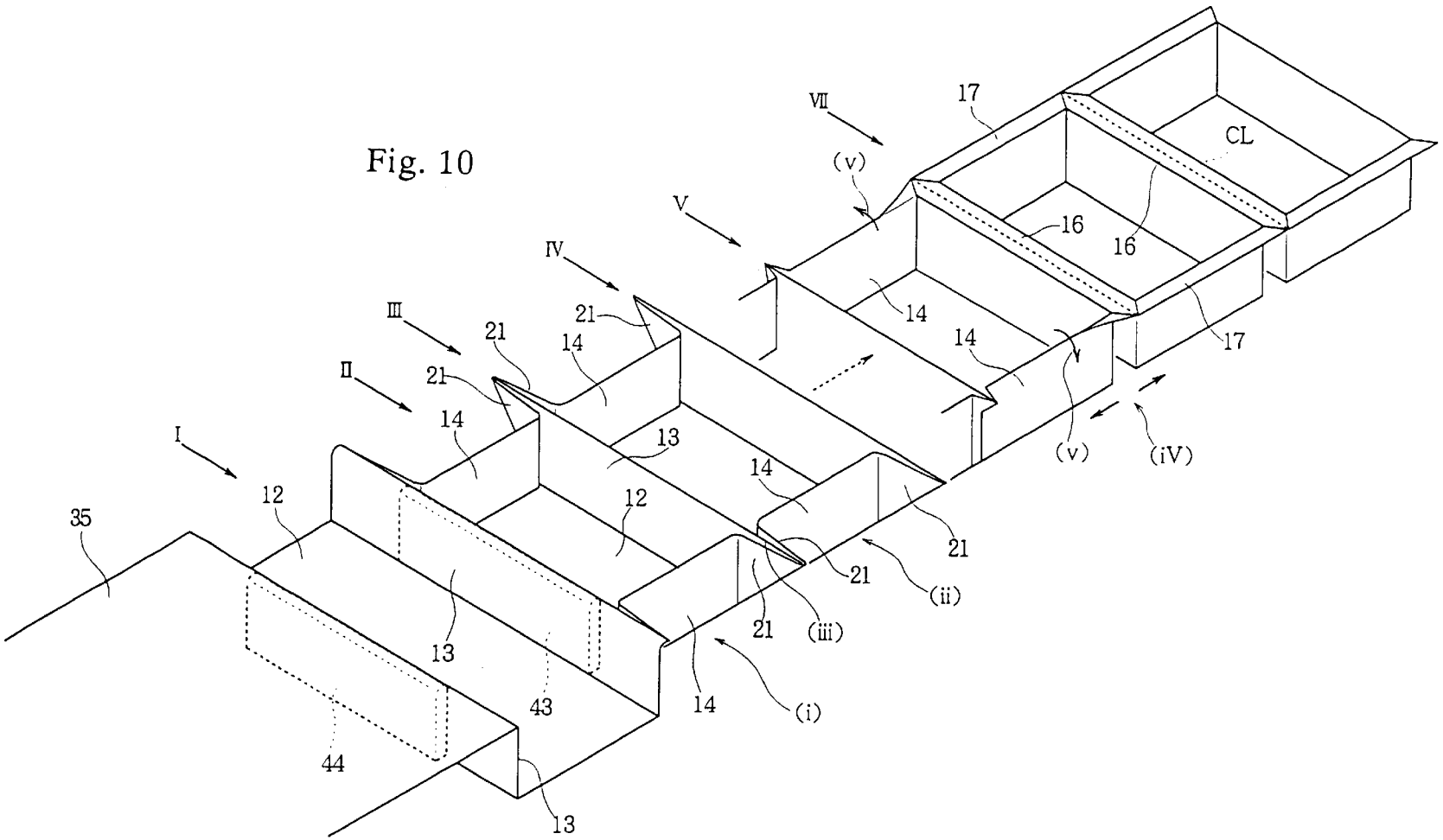
FIG. 10 is a perspective view showing a continuous package manufacturing process.
Figure 11:
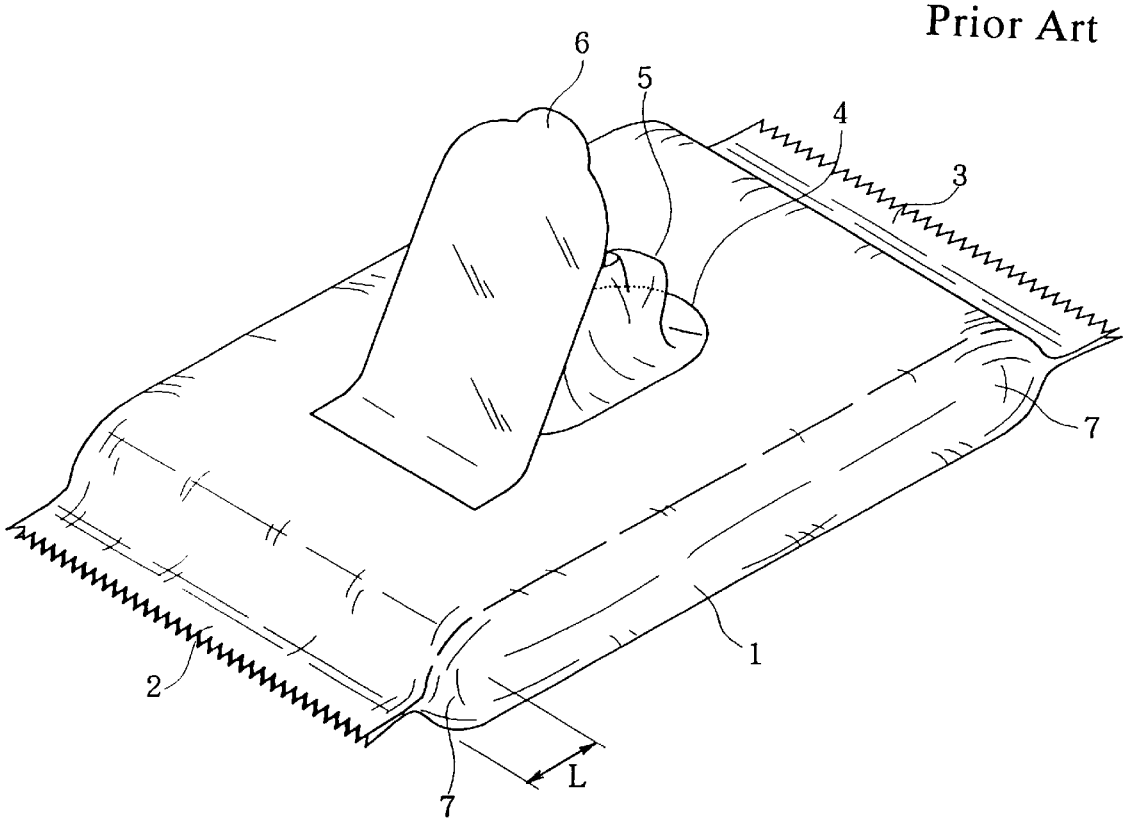
Fig. 11 Prior Art
FIG. 11 is a perspective view showing one example of the package of the prior art, which is formed of a soft sheet.

Next, FIGS. 8 and 9 show one example of an apparatus for continuously manufacturing the package (10) of the invention. FIG. 8 is a side elevation showing the entirety, and FIG. 9 is a perspective view for explaining the structure of an essential portion. On the other hand, FIG. 10 is a perspective view showing a process for continuously manufacturing the package (10).

A manufacture apparatus (40), as shown in FIGS. 8 and 9, is provided with a chain conveyor (43) which is made to run between a pair of sprockets (41, 42). This chain conveyor (43) is provided with partitions (44) which are spaced at a constant interval. These partitions (44) may always protrude from the chain conveyor (43) but are given, as shown in FIG. 8, a structure in which the running partitions (44) protrude upward only when they move upward of the drawing for the shaping works but retract into the chain conveyor (43) when they run on the lower side without the shaping works. With the partitions (44) having the retracting structure, after the box body (11) was charged with a content (50) at a sixth station (VI) of FIG. 8, the partition (44) can be extracted downward from between the adjoining box bodies (11, 11) to allow the box bodies (11, 11) to be transferred downstream as they are.

To the chain conveyor (43), on the other hand, there are attached a bottom positioning plates (45) which are interposed between the partitions (44, 44) to act as a bottom positioning portion. The partition (44) has a width size Wa equal to or larger than that of the side face portion (13) of the longer side of the box body (11). On the other hand, the height (H) of the partition (44) from the bottom positioning plates (45) is equal to the size (h) shown in FIG. 2. This size (h) is the sum of the height of the individual side face portions (13, 14) of the box body (11) and the width size (W1) of the flange portions (16, 17).

A band-shaped packaging material (35) of a soft sheet for forming the box body (11) is continuously let off a packaging material feeding portion from a raw packaging material (36) and is intermittently let off onto the chain conveyor (43) by let-off rollers (37).

At a first station (I), the upstream partition (44) is pushed at its upper end by a push plate (46) so that the packaging material (35) is pushed onto the upper end of the partition (44). Between the partitions (44, 44), moreover, there are interposed a pair of pushers (47, 47) which push the packaging material (35) onto the confronting inner faces of the bottom positioning plates (45) and the partitions (44, 44) so that the packaging material (35) is folded to form the bottom face portion (12) and the side face portions (13, 13) of the longer sides, as shown in FIG. 10.

At a second station (II), while the packaging material (35) being pushed by the same pushers (47, 47) onto the inner faces of the bottom positioning plates (45) and the partitions (44, 44), folding plates (48, 48) (as should be referred to FIG. 9) acting as folding means are raised from the two sides. As a result, as shown in FIG. 10, the packaging material (35) is folded generally at a right angle on the shorter sides of the bottom face portion (12) so that the side face portions (14, 14) are raised to form the folded projecting portions (21) having the shape of the right-angled isosceles triangle.

At a third station (III) located just downstream, temporary sealing plates (49) are forced sideways of the folding plates (48, 48) to clamp the right and left folded projecting portions (21, 21), as formed at the foregoing second station (II), between the folding plates (48) and the temporary sealing plates (49). These temporary sealing plates (49) are exemplified by hot plates, ultrasonic sealing horns or high-frequency oscillation plates to seal the inner faces of the packaging material (35) temporarily at the folded projecting portions (21). By these temporary seals, the inner faces of the packaging material (35) are point-welded only at the regions of the corner sealing portions (15), for example, as shown in FIG. 4.

At a fourth station (IV), the folded projecting portions (21, 21) projecting rightward and leftward are clamped between sealing plates (51, 52) so that the inner faces of the packaging material (35) are welded at the folded projecting portions (21) by the heat sealing, ultrasonic sealing or high-frequency sealing method, like before, to form the corner sealing portions (15) and the jointed sealing portions (24), as shown in FIG. 4.

Here at the third station (III), as shown in FIG. 10, a box body (i) formed upstream and a box body (ii) formed downstream are continuous, and the folded projecting portions (21) of the box body (i) and the folded projecting portions (21) of the box body (ii) are so continuously formed on the two sides of their boundary portions (iii) that they overlap each other. This overlap also occurs in the sealing works at the fourth station (IV).

At the station (III), therefore, the two adjoining folded projecting portions (21, 21) are clamped together between the folding plates (48) and the temporary sealing plates (49). At the fourth station (IV), too, the two folded projecting portions (21, 21) are clamped together between the sealing plates (51, 52).

The packaging material (35), as used to be fed to this apparatus, is a multi-layer sheet material having a weldable layer (or a sealant layer) for the inner face side of the box body (11) and a non-weldable layer for the outer face side of the box body (11). In this case, in the temporary sealing at the third station (III) and in the sealing at the fourth station (IV), the inner faces of the packaging material (35) are sealed to each other at the inner faces of the individual folded projecting portions (21) but not at the outer faces of the adjoining folded projecting portions (21).

At a fifth station (V), as shown in FIG. 8, the folded projecting portions (21) having the corner sealing portions (15) and the jointed sealing portions (24) are cut to leave the narrow portions (22) and the small triangular portion (23) shown in FIG. 4, while eliminating the remaining portions. Here, the cutters are not shown in FIG. 8 and so on.

At the sixth station (VI) shown in FIG. 8, the box body (11) having the narrow portions (22), the small triangular portions (23), the corner sealing portions (15) and the jointed sealing portions (24) formed, as shown in FIG. 4, is charged with the content (50). This content (50) is exemplified by a stack of a plurality of folded tissues. These stacked tissues in the box body (11) are then impregnated with chemicals fed, so that they become wet tissues.

At a next seventh station (VII), a push roller (55) acting as developing means is applied to the upper side of the box body so that the upper portions of the side face portions (14, 14) are folded outwards (v) to form the flange portions (17, 17), as shown in FIG. 10. At a next eighth station (VIII), the cover member (30), as fed from a row packaging material (38), is let off by let-off rollers (39) and is fed onto the box body by a feed roller (56). At this time, the flange portions (17, 17), as folded by the push roller (55), and the cover member (30) are pinched between the feed roller (56) and pinch rollers (57, 57). By making the feeding rate by the feed roller (56) slightly higher than the upstream one, the spacing between the upstream and downstream box bodies is enlarged, as indicated by letters (iv) in FIG. 10, so that the flange portions (16) are formed between the upstream and downstream box bodies.

When the flange portions (16) and the flange portions (17) are developed in a plane, the flange jointing portions (18) are developed and formed at the boundaries between the flange portions (16) and the flange portions (17), as shown in FIG. 5.

Downstream of the portion where the feed roller (56) and the pinch rollers (57, 57) are disposed, there are disposed a feed roller (58) and pinch rollers (59, 59) for applying a feeding force to the flange portions (17, 17) of the box body (11) and the cover member (30).

At a ninth station (IX) between the feed roller (56) and the feed roller (58), moreover, a sealing member (61) ascends from the lower side whereas a sealing member (62) descends from the upper side, both as sealing means. As shown in FIG. 9, the lower sealing member (61) is formed into such a frame shape as to place the flange portions (16), the flange portions (17) and the flange jointing portions (18) of the box body (11) on its upper face **(61*a*). As a result, the flange portions (16), the flange portions (17) and the flange jointing portions (18), and the cover member (30) are individually clamped between the sealing members (61, 62) so that the box body (11) and the cover member (30) are jointed, for example, by the sealant layer formed on the cover member (30). Here in this case, the sealing operation using the sealing members (61, 62)** may be performed by the heat sealing, ultrasonic sealing or high-frequency sealing method.

At a next tenth station (X) shown in FIG. 8, there is vertically disposed a cutting mechanism (or cutting means) (63) so that the flange portions (16) and the cover member (30) connecting the adjoining two box bodies (11, 11) are cut along a cutting line CL shown in FIG. 10, to separate the individual packages (10).

As seen from the above, the box body can be formed of the packaging material of the soft sheet and can be continuously manufactured with ease.

The completed package has the box shape so that it has no wasteful inside space when charged with a content. On the other hand, what protrudes outward from the box body is the flange portions so that the entire structure can be made small. On the other hand, the entirety is made soft in an empty state so that it takes a small volume as a waste.

On the other hand, the box body is formed by folding the packaging material of the soft sheet so that its size can be freely changed. For example, the manufacture apparatus can change the size of the box body freely by changing the size and interval of the partitions. In the manufacture apparatus, on the other hand, the box body may be oriented longitudinally or transversely with respect to the transfer direction.

The box body may be charged, after completed, with the content, or the packaging material may also be folded to envelop the content to form the bottom face portion (12) and the side face portions (13, 14).

Figure 6A:
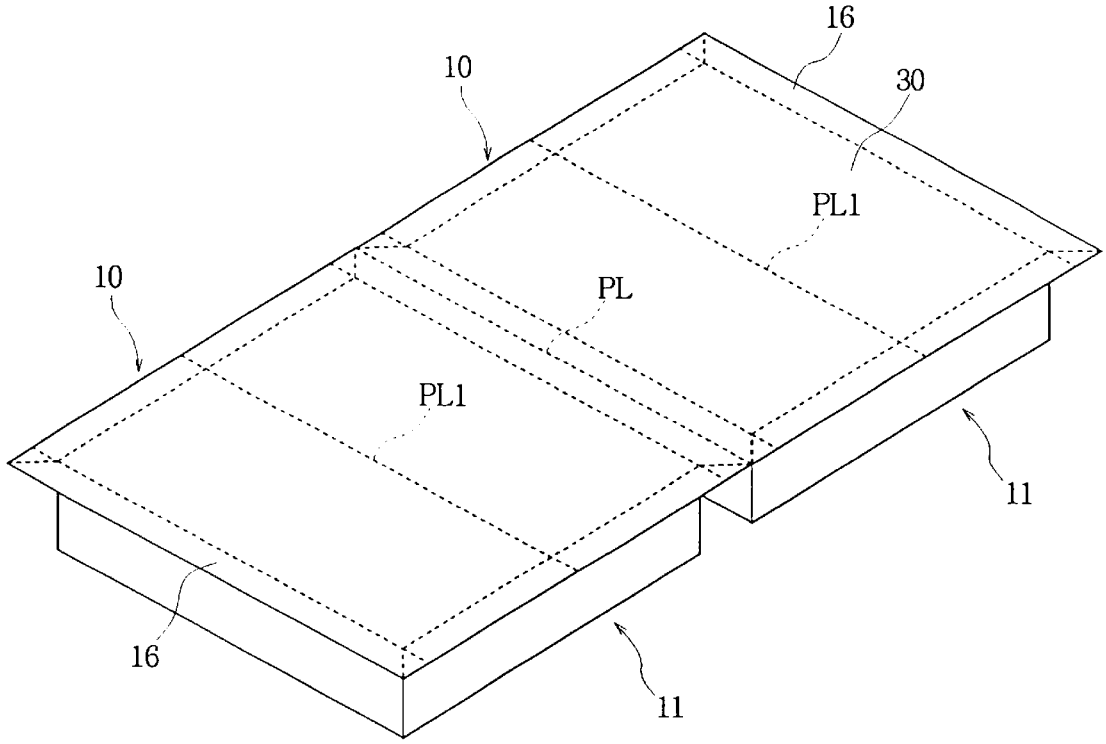
FIGS. 6A and 6B are perspective views showing modifications of the package of FIG. 1B.

Here, as shown in FIG. 6A, two continuous packages (10, 10) can be manufactured by forming perforations (or a perforation line) (PL) at an intermediate portion of the flange portion (16) connecting the box bodies (11, 11) by the cutting mechanism (63). In this case, cutting of the flange portion (16) is performed at every two box bodies (11) by the cutting mechanism (63). In the structure shown in FIG. 6A, the two continuous packages can be commercially sold as a unit, which can be separated into the individual packages (10) when the user cuts it along the perforations (PL).

Here, opening perforations (PL1) may be formed at the central portion of the cover member (30), as shown in FIG. 6A. Then, the cover member (30) can be easily opened by cutting it along the perforations (PL1). In this case, the cover member (30) may be bonded to the flange portions (16), the flange portions (17) and the flange jointing portions (18) by the easy peeling type sealant layer or may be bonded by an ordinary thermal-sealing sealant so that the cover member (30) may not be easily peeled from those flange portions.

Figure 6B:
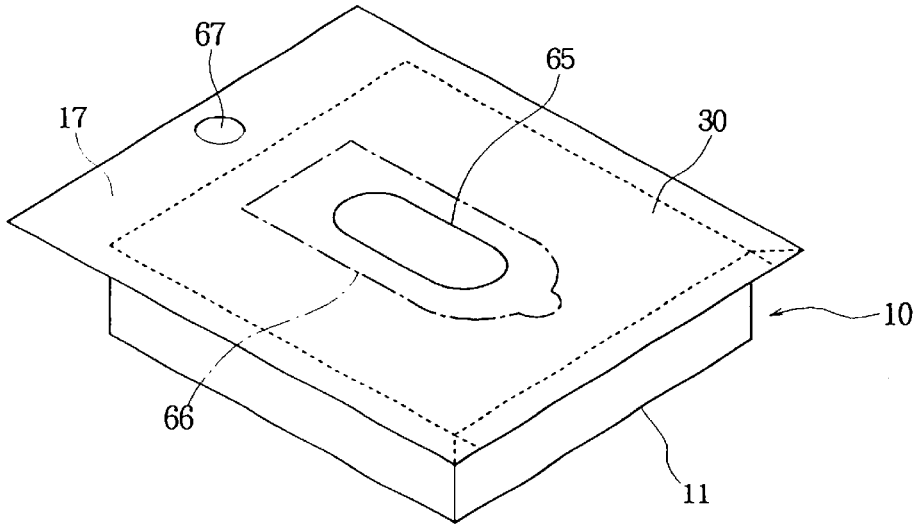

As shown in FIG. 6B, on the other hand, an opening (65) may be formed at the central portion of the cover member (30) for taking out the content therethrough. When the content such as the wet tissues needs a prevention of becoming dry, moreover, it is preferable that the opening (65) is covered with a cover sheet (66), and that the cover sheet (66) is adhered to the surface of the cover member (30) through such an adhesive layer (or sticking layer) that it can be repeatedly separated and stuck.

As shown in FIG. 6B, moreover, one flange portion (17) (and the cover member (30) bonded thereto) may be made wider than the other flange portion so that it can be holed or slotted to form a hook portion (67). With this hook portion (67), the package can be suspended from a hook bar when it is to be displayed. In order to widen one flange portion (17), as shown in FIG. 6B, an extension may be formed integrally with the flange portion (17), for example, in the structure of FIG. 5.

Figure 7:
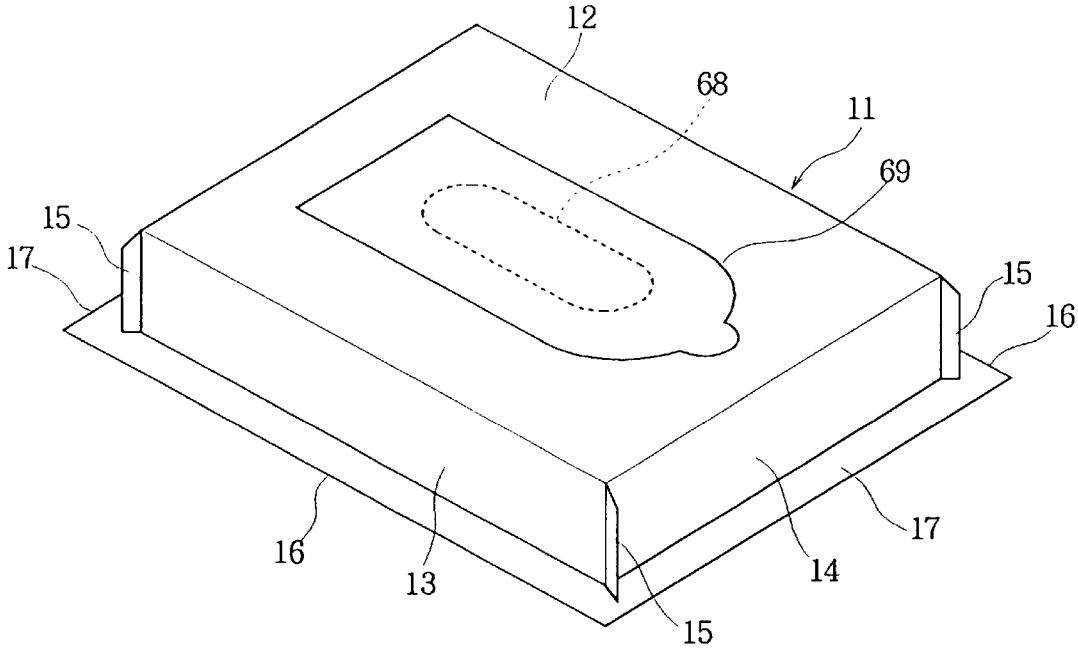
FIG. 7 is a perspective view showing a package in which an opening is formed in a bottom face portion.

Alternatively, such an opening may be formed in the box body (11). In this case, for example, the package may be used with its side closed by the cover member (30) being directed downward, as shown in FIG. 7, and an opening (68) for taking out the content may be formed in the bottom face portion (12). In this case, too, it is preferred that a cover sheet (69) may be so adhered to the bottom face portion (12) as to be repeatedly separated, and that the opening (68) is covered with the cover sheet (69).

As a result of the various structures described in detail above, advantages of the invention may include one or more of the following:

that a package of a soft sheet can have a small outer size while eliminating a wasteful region for packaging a content;

that a package of a soft sheet can be folded or crumpled small when emptied so that it can be prevented from taking a large volume as a waste; and that a package of a soft sheet can be freely changed in size, for example, by changing the size and/or interval of partitions to be used for forming a box body in a manufacture apparatus of the invention.

Although various exemplary embodiments have been shown and described, the invention is not limited to the embodiments shown. Therefore, the scope of the invention is intended to be limited solely by the scope of the claims that follow.

What is claimed is:

1. A process for manufacturing a package including a box body formed of a packaging material that is a soft sheet of a mono-layer or multi-layer structure having a resin film and a cover member for closing an opening of said box body, the process comprising the steps of:

(a) folding the packaging material to form a box body including a rectangular bottom face portion and four side face portions that are folded from four sides of said bottom face portion and four triangular projecting portions projecting outward of the box body and folded into a triangular shape, wherein each triangular projecting portion has a corner portion between first and second side face portions adjoining to each other as one side of the triangular shape;

(b) jointing said packaging material to itself in each triangular projecting portion while leaving a non-jointed portion of a smaller triangular shape having one side coinciding with said corner portion and another side extending in a plane flush with upper ends of said side face portions, so that each triangular projecting portion has a corner sealing portion in which said packaging material is jointed to itself along said corner portion and a jointed sealing portion in which said packaging material is jointed to itself to define a remaining side of the triangular non-jointed portion;

(c) folding upper portions of said side face portions outward of the box body to form flange portions while simultaneously developing said triangular non-jointed portions planarly to form flange jointing portions that are flush with said flange portions; and (d) jointing a cover member to upper faces of said flange portions and said flange jointing portions.

2. The package manufacturing process according to claim 1, further comprising, simultaneously with or after said step (b), the step of:

cutting said triangular projecting portions such that said corner sealing portion leaves a narrow portion along said corner portion and said jointed sealing portion leaves a narrow portion along said remaining side of said triangular non-jointed portion.

3. The package manufacturing process according to claim 1, further comprising, in place of said steps (c) and (d), the steps of:

(e) folding four sides of a rectangular cover member to form a rectangular flat face portion having substantially an identical size as said bottom face portion, four folded portions rising from four sides of said rectangular flat face portion, and triangular folded portions protruding outward of said folded cover member;

(f) fitting the rectangular flat face portion of said cover member in an opening of said box body formed at said step (b) such that said triangular folded portions are inserted into the triangular non-jointed portions of said box body and jointing said four folded portions of said cover member to said side face portions of said box body;

(g) folding upper portions of said side face portions outward of said box body to form flange portions and simultaneously developing said triangular non-jointed portions planarly to form flange jointing portions that are flush with said flange portions so that said folded cover member is developed planarly.

4. The package manufacturing process according to claim 1, wherein said packaging material is of a band shape having a constant width and is continuously fed at said step (a) so that a plurality of box bodies are formed continuously longitudinally of said packaging material to have a boundary portion where adjoining box bodies are connected to each other.

5. The package manufacturing process according to claim 4, wherein at said step (c), spacing between said adjoining box bodies is enlarged so that said boundary portion is developed planarly to provide connected flange portions and connected flange jointing portions between said adjoining box bodies.

6. The package manufacturing process according to claim 4, wherein after said step (d), said continuously formed box bodies are separated into individual box bodies by cutting the packaging material along every boundary portion.

7. The package manufacturing process according to claim 4, wherein after said step (d), said continuously formed box bodies are separated into individual assemblies, each comprising two box bodies that remain connected to each other, by cutting the packaging material along every other boundary portion.

8. The package manufacturing process according to claim 7, wherein in each assembly, the packaging material is perforated along said boundary portion.

* * * * *